US006264034B1

(12) United States Patent
Bacques et al.

(10) Patent No.: US 6,264,034 B1
(45) Date of Patent: Jul. 24, 2001

(54) PACKAGE, ASSEMBLY OF BLANKS, METHOD AND DEVICE FOR PACKAGING AN ARTICLES OR A GROUP OF ARTICLES OF INDEFINITE VOLUME

(75) Inventors: Jean-Yves Bacques, Paris; Gérard Mathieu, Cergy; Eric Schuster, Thorey-en-Plaine; Didier Desertot, Dijon, all of (FR)

(73) Assignee: OTOR, Paris (FR)

( * ) Notice: Subject to any disclaimer, the term of this patent is extended or adjusted under 35 U.S.C. 154(b) by 0 days.

(21) Appl. No.: 09/403,410

(22) PCT Filed: Apr. 24, 1998

(86) PCT No.: PCT/FR98/00834

§ 371 Date: Jan. 7, 2000

§ 102(e) Date: Jan. 7, 2000

(87) PCT Pub. No.: WO98/47774

PCT Pub. Date: Oct. 29, 1998

(30) Foreign Application Priority Data

Apr. 24, 1997 (FR) ..... 97/05092

(51) Int. Cl.[7] ..... B65B 53/00; B65D 25/10

(52) U.S. Cl. ..... 206/497; 53/442; 53/557; 229/122.29

(58) Field of Search ..... 53/442, 449, 556, 53/557; 206/497, 583, 592, 594; 229/122.28, 122.29, 122.3, 122.31, 122.32, 164.2

(56) References Cited

U.S. PATENT DOCUMENTS

| | | | | |
|---|---|---|---|---|
| 1,250,357 | * | 12/1917 | Rosenwald | 229/122.29 |
| 3,586,233 | | 6/1971 | McCulloch . | |
| 5,323,896 | | 6/1994 | Jones . | |
| 5,676,245 | * | 10/1997 | Jones | 206/497 |
| 6,010,003 | * | 1/2000 | Wilkinson | 206/497 |

FOREIGN PATENT DOCUMENTS

| | | |
|---|---|---|
| 81 15 943 | 5/1981 | (DE) . |
| 91 05 265 | 4/1991 | (DE) . |
| 0 228 331 | 12/1986 | (EP) . |
| 0 323 354 | 12/1988 | (EP) . |
| 0 447 282 | 2/1991 | (EP) . |
| 0 712 784 | 7/1991 | (EP) . |
| 0 577 457 | 6/1993 | (EP) . |
| 0 694 480 | 7/1995 | (EP) . |
| 2 426 620 | 5/1978 | (FR) . |
| 2 506 722 | 6/1981 | (FR) . |
| 2 577 519 | 2/1985 | (FR) . |
| 2 589 444 | 10/1985 | (FR) . |
| 2 577 001 | 12/1985 | (FR) . |
| 2 593 781 | 2/1986 | (FR) . |
| 2 659 292 | 3/1990 | (FR) . |
| 2 661 392 | 4/1990 | (FR) . |
| 2 665 137 | 7/1990 | (FR) . |
| 2 703 656 | 4/1993 | (FR) . |
| 87/02644 | 10/1986 | (WO) . |

* cited by examiner

*Primary Examiner*—Jim Foster
(74) *Attorney, Agent, or Firm*—Merchant & Gould P.C.

(57) ABSTRACT

Cardboard packing case for transporting a load with a base and at least four walls, a film made from heat-shrinkable plastic material, and a horizontal added board for pressing down and holding the heat-shrinkable film flat on the inner face of the base of the case, the board having a median line parallel to two walls for longitudinal folding of the board into a tent shape, the median line having a ridge facing towards the top of the case, wherein the film is in the form of a rectangular curtain in a single piece emerging on either side of two opposite edges of the board parallel to the median folding line and extending from those edges over a length sufficient to cover over one another, such that the film envelopes the load and immobilizes it by heat shrinking of the film, and a process and device for producing such a packing case.

28 Claims, 9 Drawing Sheets

PACKAGE, ASSEMBLY OF BLANKS, METHOD AND DEVICE FOR PACKAGING AN ARTICLES OR A GROUP OF ARTICLES OF INDEFINITE VOLUME

The present invention relates to a packaging of the cardboard-case type equipped with a shrinkable film which is secured to it, intended for packing articles to be delivered in variable numbers or volumes.

It also relates to a set of blanks which make it possible to obtain such a packaging.

It also relates to a process and device for forming packing packaging of the cardboard-case type equipped with a shrinkable film.

It applies particularly well, although not exclusively, to the field of the transportation of heavy objects, i.e. which weigh in excess of one kilogram, for example three kilograms, and have an irregular shape.

Such packing is also particularly suited to objects such as cans, bottles, medicines or various documents, taken as a group or singly, in one and the same package particularly intended for delivering to a retailer, such as a book-seller, pharmacist and, more generally, retail trade.

It is known that, when preparing their retailers' order, wholesale traders need to pack batches of articles of different types in packages which nevertheless have to withstand difficult conditions of transportation and delivery.

Given the cost of standard cases, it quickly became apparent that it was difficult to use such packages to pack batches of articles of this type, because this would require the use of ranges of packages whose storage would be costly and consequently unsuitable for this type of distribution.

A number of solutions to this type of problem are already known.

It has also long been proposed to pack batches of articles inside a case or a tray, particularly made from cardboard, covered over by a sheet of heat-shrinkable plastic connected to the inner face of the base of the case and/or to the inner face of the two opposite vertical walls.

In this way, it suffices to arrange the objects to be packaged inside a cardboard base, and to then cover them over with the plastic sheet which will ultimately be fully shrunk over the products by passing through a heating tunnel, for example, with the result that the said products are kept satisfactorily stowed in the transportation case.

Such solutions are normally very advantageous since they need only a single case with a minimum volume of cardboard, yielding substantial savings of material in addition to savings in storage of the packaging, which has been brought down to a single type.

In this connection, FR-2,426,620 discloses a packaging in which use is made of two plastic sheets which overlap at one of their ends over the load in order to be heat-welded there at the overlap zone, the other of their ends, which is not in contact with the load, being bonded to the inner face of the base or close to the base on the inner face of a side wall of a cardboard case obtained from a simple blank forming the base of the case from which extend two lateral faces which are firstly folded down over the load before the two plastic sheets which will hold the assembly together by means of welding are folded down.

However, this particular packaging suffers from the assembly's lack of mechanical strength. Indeed, the packing is linked to the resistance to detachment or to tearing-away of the joins of the plastic sheets to the base or the side walls of the cardboard case. In point of fact, it is well known that such packagings are subjected to high stresses when handled and transported, which frequently leads to the breaking of the joins of the plastic films with the cardboard base.

In this connection, other solutions have been proposed, based, this time, on the observation that the resistance to detachment or to tearing-away of the sheet-type heat-shrinkable materials during handling and/or transportation operations was improved when the join of the heat-shrinkable materials to the case was produced outside the case on at least one outer face (base or side wall) of the latter, the area of the face, which is covered over by the sheet-type heat-shrinkable material, acting as a means to oppose the stresses exerted by the weight of the load.

In this connection, several solutions have already been proposed.

French Patent FR-A-2,593,781 describes a packing case consisting of a box, for example made from cardboard, and of a sheet-type heat-shrinkable material for packaging and holding a load in position. The sheet-type heat-shrinkable material is linked by at least one of its borders to the outer surface of a wall of the box in the vicinity of the edge of the said wall and is extended outside from the said border towards the edge of the said wall then inside the box opposite the inner surface of the said wall while moving away from the latter towards the load to be packaged.

A similar solution is found in French Patent FR-A-2,589,444, according to which the heat-shrinkable sheets are inserted between the inner faces of the walls and portions of these same walls folded towards the inside of the case.

These latter solutions have the drawback either that they need a cover in the first case, or that provision has to be made at the outset for a special cutout, which is costly in terms of materials and gives rise to excess expense in terms of the stock management of such packagings. Moreover, these solutions are mechanically more complex because they require two plastic sheets, which substantially complicates the assembly operations.

Another solution has been proposed in French Patent FR-2,577,001, which describes an "American case" or the like, which uses a heat-shrinkable film made from plastic material secured to the base of the case.

The film made from plastic material is pinched between the outer flaps adjoining two parallel walls of the case, and forming the actual base of the packaging, and the inner flaps adjoining the two other walls and lining the base on the inside.

This latter solution has the advantage that it can be mechanized relatively easily since the heat-shrinkable film can be inserted continuously from a reel and, moreover, the solution does not require any bonding of the said film to the base of the case, thereby remedying the abovementioned drawbacks.

On the other hand, this further solution is unsatisfactory since it can be used only with "American cases" with a complete base, excluding, for example, cases with small flaps and also trays with exterior or interior bonded corners and jointed "American cases", which are closed by means of an independent bonded lid.

Also known (FR-2,659,292) is a cardboard packing case for the transportation of a load, including a succession of sections forming the side walls of the case, which are joined in pairs by first joining lines which are parallel to each another, the succession of sections including two series of two principal sections which are opposite in pairs, and a first set of lateral flaps arranged on one side and joined to the principal sections by second joining lines which are perpendicular to the first joining lines, and comprising at least two first opposite flaps forming, at least partially, the base of the case.

The case also comprises a heat-shrinkable film made from plastic material intended for packaging and holding the load in position and means for fastening the film to the base of the case.

Such a case also suffers drawbacks due to the risks of tearing-away, such as those described above.

Document DE-U-81 5943 describes a packing case with one or more rigid multistage boards inserted into a tube made from heat-shrinkable plastic material.

The boards are difficult to insert in the tube and such a case allows the transportation only of small articles, such as nails or medicines or of lightweight textile articles such as shirts.

Finally, also known (FR-2,661,392) is a case with a plastic film and wedge for holding the film on the base of the case, the wedge including lateral wings provided with self-locking means on the side.

Such a case is difficult to produce owing to friction inherent in its assembly and provides unreliable locking which does not exclude tearing-away in the event of shocks.

Also known (U.S. Pat. No. 5,323,896) is a case with film in the form of a tube and foldable board, which is complicated to implement.

Also, documents FR-A-2,661,392 and U.S. Pat. No. 3,586,233 describe blanks and processes with cut-outs having wings or flaps to improve the solidity of the packaging or the behaviour of the film, although inadequately.

The present invention aims to provide a case, a set of blanks, a process and a device for forming a case which, better than those known previously, meets the requirements of the field, particularly in that it allows fastening of the plastic film to a case base which is itself firmly held and sufficiently robust to guarantee the transportation of a load in complete safety, thereby remedying the various drawbacks of the prior-art solutions.

To this end, the invention proposes, in particular, a cardboard packing case for transporting a load, comprising a base, at least four side walls, namely two first opposite walls and two second opposite walls, a film made from heat-shrinkable plastic material intended for packaging and for holding the load in position and means for fastening the said film to the base of the case including a horizontal attached board for pressing down and holding the heat-shrinkable film flat on the inner face of the base of the case, characterized in that the board includes a median or substantially median line for provisional longitudinal folding of the board into a Chinese hat, with a ridge facing towards the top of the case, the said median line being parallel to the two second walls.

Median or substantially median folding line must be understood to mean a line parallel to the two opposite second walls of the case, which is centred relative to the board, of which it forms, for example, an axis of symmetry, or, alternatively, located on one side or the other of this axis of symmetry at a distance which is less than or equal to one quarter of the transverse dimension of the board, for example between one eighth and one tenth.

The board according to the invention is thus formed from two board portions joined together by a folding line.

Such a solution offers a number of advantages over the teachings of the prior art in that it allows the case forming the receptacle to be equipped genuinely efficiently with a heat-shrinkable film intended to envelop any load without risking the problems of detaching or tearing-away during handling or shocks during transportation.

The presence of the folding line will allow easy insertion of the board during assembly, permitting assembly rates which are higher than those permitted with prior-art cases.

In an advantageous embodiment of the invention, the film is in the form of a rectangular curtain of heat-shrinkable plastic material in a single piece emerging on either side of the two opposite facing edges of the said board parallel to the median folding line and extending from the said edges over a length which is sufficient to cover over one another, enveloping the said load and immobilizing it by means of heat-shrinking of the film.

This solution is also well suited to continuous manufacture in that use is made of a shrinkable film in a single piece, since it is sufficient to provide, in addition to a reel of heat-shrinkable film, planar elements which are cut at the appropriate time to the dimensions of the base of the tray, case or any other container made from compact corrugated cardboard or other sheet material, the film then being fitted simply by means of insertion between two opposite side walls of the container to be equipped.

According to another important characteristic of the invention, the board which will constitute a double base for the container is obtained from a corrugated-cardboard blank in which the direction of the ribs will be oriented as will be explained below.

In advantageous embodiments, use is also made of one and/or another of the following arrangements:

the board is inserted between the two second opposite principal sections so that the edges of the board are in contact, via the film of plastic material, with at least a part of the inner lower edges of the case at the bottom of the said second walls;

the board is inserted forcibly between the said inner lower edges of the case at the bottom of the said second walls;

the board includes, over at least one of its two opposite edges, located on the same side as the second sections, at least one tenon, the said tenon collaborating with a corresponding recess made in the inner lower edge of the case, at the bottom of the said corresponding second sections, once the board is in place against the base of the case;

the board is made from corrugated cardboard in which the direction of the ribs is perpendicular to the lines of contact with the second principal walls between which the said board is inserted;

the lower face of the board is at least partially directly bonded to the upper face of the base of the case through at least one hollowed-out part of the film made from heat-shrinkable material which is in a single piece.

In this way, cardboard elements and plastic material are easily detached from one another, as the plastic film is not bonded to the cardboard;

the board totally covers over the base of the case in order to constitute a double base;

the board includes means for tearing the said board from the base, allowing manual separation of the cardboard parts and releasing the plastic material;

the case includes a succession of sections forming the side walls of the case, which are joined in pairs by first joining lines which are parallel to each other, the said succession of sections including two series of two principal sections which are opposite in pairs, and a first set of lateral flaps arranged on one side and joined to the principal sections by second joining lines which are perpendicular to the first joining lines, and comprising at least two first opposite flaps forming, at least partially, the base of the case, the two first flaps each comprising, respectively, on their two lateral sides, reinforcement tabs which are folded down and bonded to the outer face of the principal sections, called second principal sections, corresponding to the second walls adjacent to the principal sections corresponding to the said first flaps; called first principal sections, and corresponding to the said first walls;

the set of lateral flaps comprises second opposite flaps joined to the second principal sections by second joining lines;

the second flaps are folded down through 18020 about their second joining lines and bonded to the inner face of the corresponding second principal section;

the tenons include a periphery which has two successive stages and the recesses consist of grooves of a shape which complements the tenons passing successively right through the corresponding second flaps and second sections in the direction of the thickness;

the first flaps are contiguous at their ends opposite the second joining lines with the first sections;

the board includes two opposite, end, third flaps connected to the board by third joining lines, coinciding with the first joining lines between first sections and first flaps, the said third flaps being pressed down and bonded to the inner face of the said facing first sections;

the succession of sections ends in a fastening tongue, the said second joining lines are aligned or substantially aligned and the case is arranged so that it can be assembled automatically by folding down the said sections and flaps of the said first set around a mandrel, the end section of the succession of sections and the tongue on the one hand and the tabs of the first flaps and the outer face of the second adjacent sections on the other hand being fastened together by bonding in order to form the case.

the succession includes eight sections, namely four principal sections separated in pairs by four intermediate sections.

It goes without saying that the embodiments more particularly described here, which are half-cases, are envisaged as constituting cases according to the invention and include, to this end, lids which are known per se, for example consisting of flaps joined to the walls by folding lines or of an added lid in the form of a board which may or may not be joined by a folding line to a wall.

The present invention also proposes a set of blanks which makes it possible to produce a case of the type described above.

It also proposes a set of blanks for producing a packaging case including a first blank comprising a succession of sections suitable for forming the side walls of the case, which are joined in pairs by first joining lines which are parallel to each another, the said succession of sections ending in a bonding tongue and including two series of two principal sections, and a first set of lateral flaps arranged on one side and joined to the principal sections by second joining lines which are perpendicular to the first joining lines, namely two first flaps and two second flaps intended to form the base of the case, characterized in that the two first flaps each comprise, respectively, on their two lateral sides, reinforcement tabs arranged so that they can be folded down and bonded to the outer face of the principal sections, called second principal sections, adjacent to the principal sections corresponding to the said first flaps once the case has been formed, in that the second lines forming a join with the second principal sections each include at least one recess and in that the said set includes a second blank in the form of a substantially rectangular board equipped on its longitudinal edges with at least one tenon suitable for cooperating with the said recess and, on each of its transverse edges, with a tongue suitable for cooperating with the inner face of a first section once the case has been formed, the said board including a median or substantially median line for longitudinal folding of the board into a Chinese hat parallel to the longitudinal edges of the said board.

Advantageously, the board comprises means for tearing the said board by pulling.

The invention also proposes a process for forming a cardboard packing case or the like for the transportation of a load, such as described above.

The invention also proposes a process for forming a corrugated-cardboard case or the like for the transportation of a load, which includes the following stages:

the base and the vertical walls of a case which is left open at the top are formed, a board with longitudinal dimensions which are substantially equal to those of the base is provided, the said board comprising a median or substantially median folding line parallel to its longitudinal sides which are suitable for cooperating with two opposite vertical walls of the case, called second walls, the board is folded into a Chinese-hat shape about the said folding line, the said board being placed over a sheet of plastic material arranged so as to allow curtain portions of free material extending from the said edges over a sufficient length to escape on either side of the two opposite facing edges of the board in order to cover over each other, totally enveloping the load and immobilizing the said load by means of heat-shrinking of the film, the sheet of plastic material and the board in the form of a Chinese hat are introduced into the case until they come into a position in which the said sheet is immobilized between board and base by means of the board being placed horizontally and abutting against the base of the case, the load is inserted on the board into the case and the curtain portions are closed over the load before immobilization by means of heat-shrinking and closure of the lid of the case.

Advantageously, the sheet of plastic material comprising at least one perforated part, the bottom of the board or the inner face of the base is previously coated with adhesive facing the perforated part, and the board is bonded to the base through the said perforated part when the board is placed horizontally and abuts against the base.

Advantageously, also, the board comprising two lateral flaps, called third flaps suitable for being pressed down on two opposite facing walls of the case perpendicular to the folding line of the board, the said third flaps are folded against the upper face of the board before insertion of the board into the case and the pressing-down faces of the said third flaps are coated with adhesive, then, after insertion of the board into the case, the said faces are pressed for bonding against the walls by automatic righting of the third flaps when the board is pressed down on the base.

In another advantageous embodiment, the base and the walls of the case are formed about a mandrel.

Advantageously, the base of the case including two first flaps and two second flaps, the second flaps are folded down through 1800 about their joining lines with the walls and they are bonded to the inner face of the adjacent walls.

Advantageously, also, the plastic sheet is inserted into the case in a manner which is staggered over time and in space relative to the board, i.e. not simultaneously with the board, before the latter, being shaped as a funnel or as a hollow, relative to the opening of the case, which allows its insertion without damage or risk of inconvenient friction.

The invention also proposes a device for manufacturing a cardboard packing case or the like for the transportation of a load, the said case comprising a lateral surround formed from at least four vertical walls and from a horizontal base secured to the said surround via joining lines, and a heat-shrinkable plastic film material intended for packaging and for holding the said load in position, characterized in that it comprises means for forming the base and the vertical walls of the case, means for providing a film made from plastic material over the said case, means for providing a board which has previously been folded into the shape of a Chinese hat about a longitudinal folding line of the said board above the said film, and means for inserting the film into the case and inserting the board in the shape of a Chinese hat into the said case, the said means being suitable for pressing down the said board by pushing down on top until the heat-shrinkable film is pressed down on the inner face of the base of the case, allowing curtain portions of free material extending from the said edges over a sufficient length to escape on either side of the two opposite facing edges of the said board in order to cover over one another in a second stage, totally enveloping the load.

Advantageously, the device includes means for cutting out at least one hole in the film made from plastic material and means for coating the base of the case facing the said hole with adhesive after insertion of the film in the case.

Advantageously, also, the device also includes means for inserting the load into the case, means for folding down the curtain portions over the load, and means for heating the film in order to heat shrink it over the load.

Further advantages and characteristics will become more clearly apparent from the description of several embodiments of the case, of the set of blanks, of the process and of the device in accordance with the invention, which are given in a non-limiting manner.

The description relates to the drawings which accompany it, in which.

FIGS. 17 to 22 diagrammatically show a device according to an embodiment of the invention during various stages of the forming of a case according to an embodiment of the invention;

FIGS. 23 to 28 are perspective views showing the various stages for making up a case in accordance with another variant of the invention.

Figure 1:
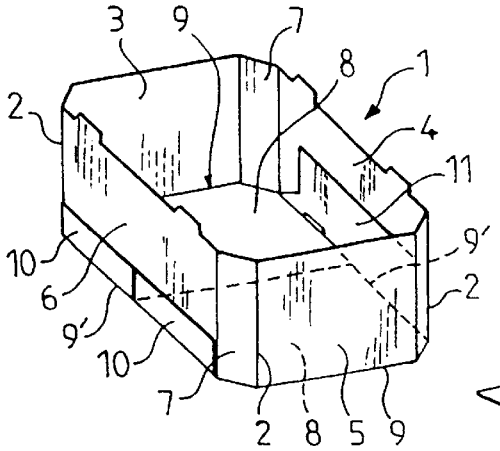
FIGS. 1 to 8 are perspective views showing the various stages in making up a case in accordance with a first variant of the invention.
Figure 2:
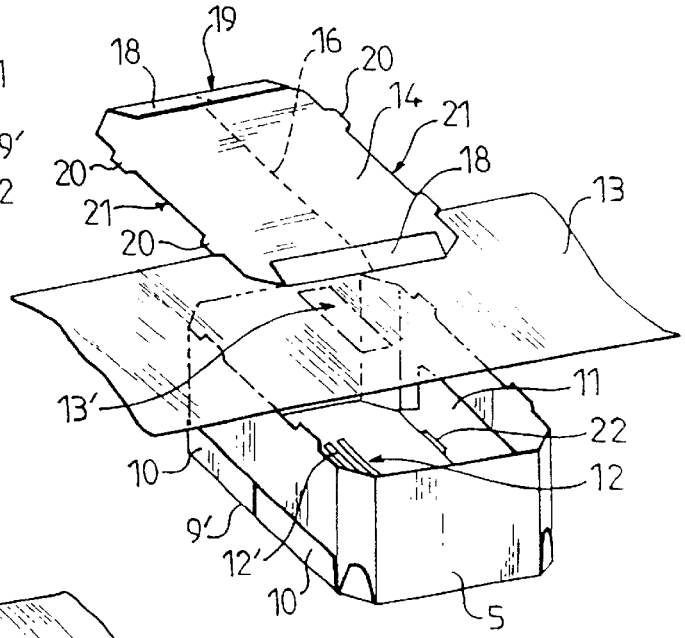
Figure 3:
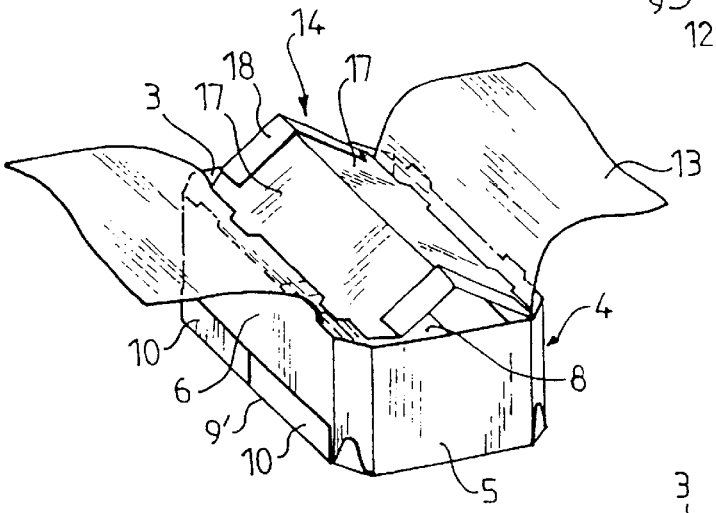

FIG. 1 shows a half-case 1 for packing a load, which includes a succession of sections forming the side walls of the case, joined in pairs by first joining lines 2, which are parallel to one another.

The succession of sections includes two first opposite principal sections 3 and 5 and two second opposite principal sections 4 and 6, the principal sections being separated by intermediate sections 7 forming cut-off corners of the case.

The first sections 3 and 5 include first flaps 8, joined at the bottom of the said first sections by second joining lines 9 perpendicular to the first joining lines 2.

According to an embodiment of the invention, the two first flaps each comprise, respectively, on their two lateral sides, reinforcement tabs 10 which are folded down and bonded to the outer face of the second principal sections 4 and 6.

The two first flaps are contiguous at their ends located on the side opposite the folding lines 9 between first flaps and first sections.

The tongues 10 are also contiguous at their ends and extend right along the first flap facing the corresponding second section.

The second principal sections 3 and 5 include, at the bottom, second flaps 11 joined to the said sections by second joining lines 9'.

The second sections are folded down through 180° relative to the joining lines 9' and bonded to the inner face of the said second sections 4 and 6.

FIGS. 2 to 8 show, in perspective, the successive stages in forming the cardboard packing case according to the embodiment of the invention which is more particularly described here.

After the coating with adhesive, at 12, of the upper face of the base of the case, i.e. of the inner face of the first flaps 8, over a central surface of specific area, a sheet 13 made from heat-shrinkable plastic-material film is placed over the half-case 1, the sheet including a central perforated part 13', with an area which is slightly larger than that of the central surface and arranged in order to face the bonding points or lines 12' of the inner face of the base.

Coating with adhesive 12 facing the perforated part may also and advantageously be carried out on the lower face of the board.

The film 13 made from plastic material is cut out to form a substantially rectangular layer and has dimensions which will be specified below.

Provision is also made for an added board 14 made from two-sided corrugated cardboard, whose rib lines are arranged perpendicularly to the second sections 4 and 6.

The board has the same shape and substantially the same dimensions as the base of the half-case 1 and includes, right along its length, a longitudinal folding line 16, for example a line of symmetry of the board.

The folding line 16 is arranged to allow the two lateral panels 17 of the board to be folded downwards.

It may also be off-centre, its aim being to allow the board to be folded into the shape of a Chinese hat, as shown in FIG.

3, and to permit its insertion without friction inside the half-case 1, for example pushing in the film of plastic material.

The board also includes third rectangular opposite end flaps 18, joined to the board by third joining lines 19 arranged to coincide with the first joining lines between the first sections and the first flaps.

These third flaps 18 are folded down towards the inside of the board, which will make it possible to keep them towards the inside of the board when the latter is inserted into the half-case 1.

The board also includes four tenons 20 located, respectively, in pairs and symmetrically with respect to the folding line 16 on its opposite longitudinal edges 21, perpendicular to the third joining lines 19.

The tenons 20 are, for example, trapezoidal, rectangular or stepped in shape, and are arranged in order to cooperate with recesses 22 located on the inner lower edge of the case at the bottom of the second sections 4, 6, i.e. coinciding partially with the second folding lines 9' between second sections and second flaps.

Each recess is produced straddling the corresponding second folding line, forming, according to the embodiment of the invention more particularly described here, a hollowed-out part on either side of the said line in the form of a slot with a thickness equal to that of the board 14.

After the board 14 has been shaped into a Chinese hat, it is then inserted, pushing in the sheet 13 of thermoplastic material downwards.

Figure 4:
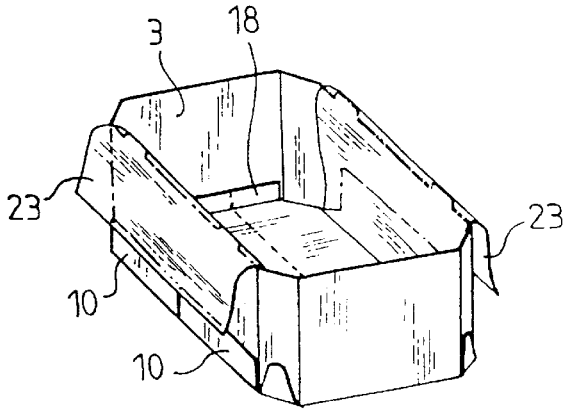
Figure 5:
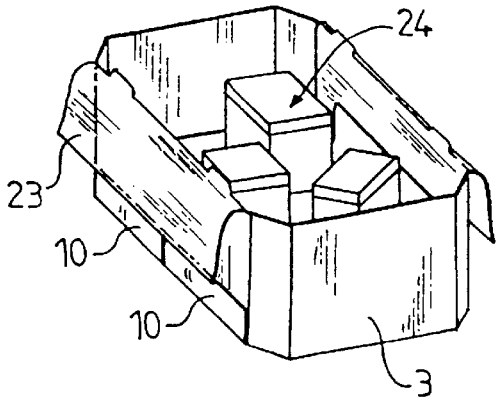
Figure 6:
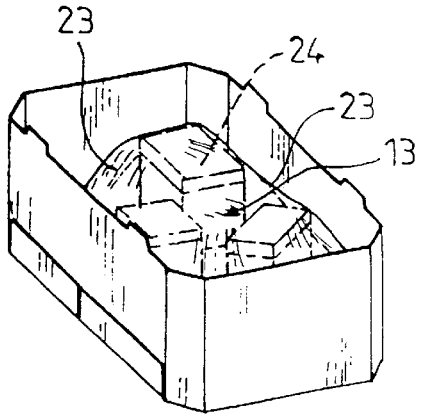
Figure 7:
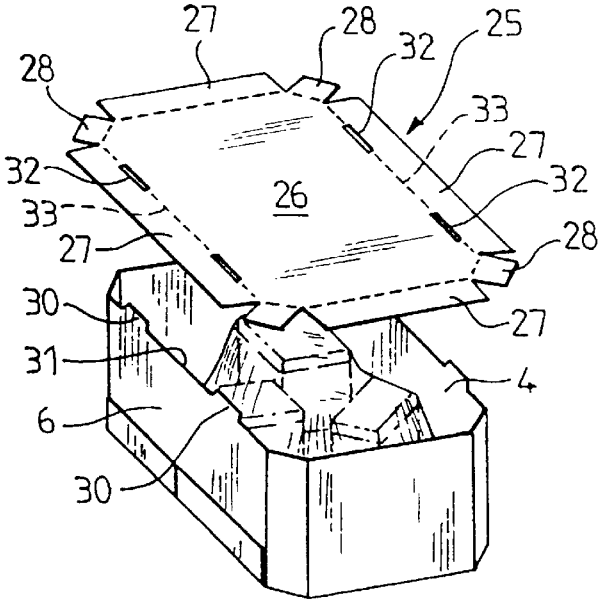
Figure 8:
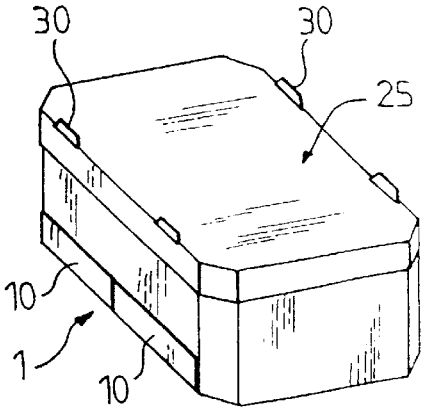

As shown in FIG. 4, the sheet made from thermoplastic material has curtain portions 23 of free material extending from the opposite edges 21 of the board equipped with tenons 20 over a length which is sufficient, in a first stage, to fall outside the half-case over the walls formed by the second sections 4 and 6 when the sheet made from plastic material is pressed down on the base of the half-case (cf. FIG. 4), and, in a second stage, to cover over each other, fully enclosing the load and immobilizing the said load 24 by means of heat-shrinking of the film 13 (cf. FIGS. 5 and 6).

The board 14 in the shape of a Chinese hat is pressed down on the base of the case until it reaches a position in which it immobilizes the sheet between board and base, by the said board being placed horizontally and abutting against the base of the case, the tenons 20 snap-fitting into the recesses 22, trapping the film made from plastic material in the said snap-fittings.

The plastic film pushed back by the end of the tenons is also protected against any exterior contact by the outer tabs 10 located facing the recesses of the folding lines 9' between second sections and second flaps.

When the board 14 is being placed horizontally, the third flaps 18 are upright and, having been previously coated with adhesive, naturally bond, with pressure, on the inner bases of the first sections 3 and 5, consolidating full fastening of the film made from plastic material to the base of the case.

The packaging is then completed (cf. FIGS. 7 and 8) by adding a lid 25 consisting, in a manner known per se, of a central section 26 with a shape and dimensions which are identical to those of the horizontal cross section of the case, the said central section including rectangular lateral flaps 27 arranged to be bonded to the upper part of the outer face of the corresponding principal sections, and small end tongues 28 arranged to be bonded to the outer face of the intermediate sections 7 of the case.

Finally, to facilitate positioning of the case and, if appropriate, to allow its easier stacking, lugs 30 on the upper edge 31 of the second principal sections 4 and 6 are provided, in which case complementary recesses are, for example, made in line with these on the base of the case.

Recesses 32 in the form of a slot are also made on the lid 25 along the folding lines 33 between the principal section 26 and the lateral flaps 27 corresponding to the upper edges equipped with the lugs 30 of the half-case.

Figure 9:
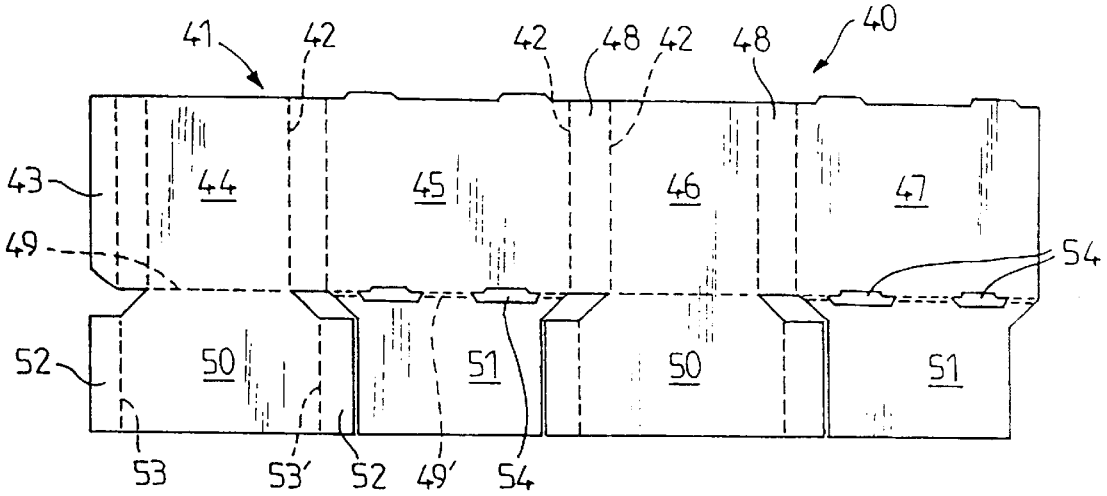
FIG. 9 is a plan view of the blank which makes it possible to assemble the half-case of FIG. 1.
Figure 9A:
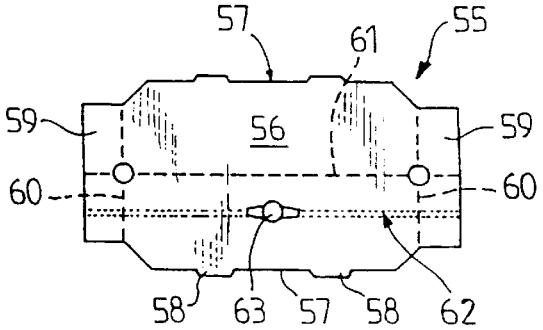
FIG. 9A is a plan view of the added board of the type in FIG. 2, with a tear-away strip.

FIGS. 9 and 9A show the set of blanks for producing the packaging half-case described with reference to FIGS. 1 to 8.

The set includes a first blank 40 consisting of a succession of sections 41 joined in pairs by first folding or joining lines 42, which are parallel to one another, the said succession of sections ending in a bonding tongue 43 and including two series of principal sections, namely a first series of sections, called first sections 44 and 46, and a second series of sections, called second sections 45 and 47.

The principal sections are also separated by and/or end in, if appropriate, intermediate sections 48 suitable for forming the cut-off corners of the case.

The blank includes a first set of lateral flaps arranged on one side and joined to the principal sections by second folding lines 49 and 49', aligned or substantially aligned with one another, namely two first flaps 50 joined to the first sections 44 and 46, and two substantially rectangular second flaps 51 joined to the two second sections 45 and 47.

More specifically, the first flaps have a substantially rectangular shape which includes, in the vicinity of the second joining lines 49, an oblique, 45° part extending towards the outside from the second joining lines, then a straight part parallel to the first folding lines 42.

According to the embodiment of the invention more particularly described here, the first flaps each include, respectively, on the part of their two lateral sides parallel to the first folding lines 42, reinforcement tabs 52 joined to the said flaps by folding lines 53 and arranged so as to be folded down and bonded to the outer face of the adjacent second principal sections 45 and 47 about the said folding lines, which are simple.

In one embodiment, the lines 53 are double.

The second flaps 51 are joined to the second sections 45 and 47 by second folding lines 49' which are, as indicated above, aligned or substantially aligned with the second joining lines 49 between first flaps and first sections. The second flaps have sides with a shape which complements the first flaps, to optimize use of the cardboard.

The lines 49' are, for example, double in the particular case of very thick corrugated cardboard so as to allow the 180° folding-down of the second flaps 51 on the inner faces of the future half-case.

The second joining or folding lines 49' comprise, for each flap 51, two recesses 54 in the form of a slot, for example 3 cm in length and with a width equal to or slightly larger than two board thicknesses.

For example, and more specifically, the recess comprises a first slot part, with a width equal to one thickness of added board, hollowed out in the second section along the first line of the double folding line 49', and a second slot part, with a width which is also equal to that of the board, hollowed out in the second adjacent flap along the second folding line of the double line.

FIG. 9A shows a board 55 equipped with a central section 56 of octagonal shape identical to that of the base of the half-case produced with the blank 40, which includes, on its two longitudinal edges 57, tenons 58 arranged in order to cooperate with the recesses 54.

On its two other opposite sides, the board comprises, respectively, two rectangular third flaps 59 joined to the central section by third joining lines 60.

The board also includes a central folding line 61 which coincides with the longitudinal axis of symmetry of the board.

Finally, the board includes a double tear-away strip 62 (for example, a strip made from plastic material inserted into the cardboard), which the user can hold, for example, via the hole 63 provided for that purpose.

By pulling on each side, it is possible to release and tear away the rest of the board when the packaging is subsequently destroyed, such an arrangement making it possible, in particular, for ecological reasons, to separate cardboard waste products from plastic waste products.

Figure 10:
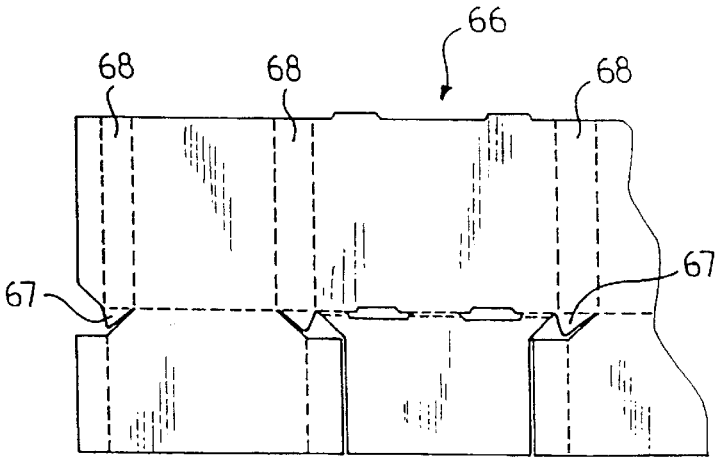
FIG. 10 is a partial plan view of a blank which makes up the half-case according to another embodiment of the invention, with tongue on cut-off corners.

FIG. 10 shows another blank embodiment 66, with eight sections.

Figure 11:
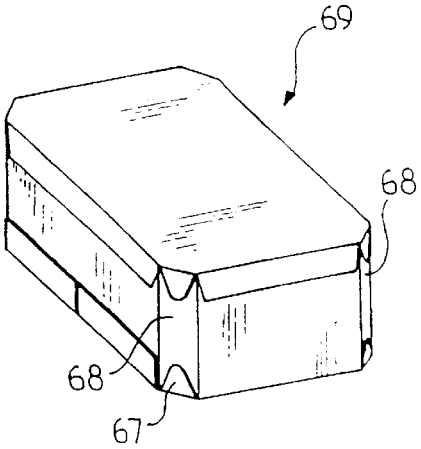
FIG. 11 is a case obtained with the blank of FIG. 10, closed by a lid.

The blank 66 includes tongues 67 on the ends of the intermediate sections 68 forming the cut-off corners of the case 69 of FIG. 11.

Figure 12:
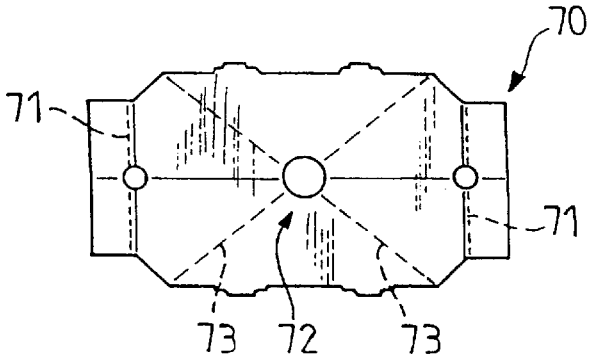
FIG. 12 shows another embodiment of the added board used according to the invention, with a cross-shape breakable tear-away zone.

FIG. 12 shows another embodiment of a board 70 according to the invention which, here, comprises third double joining lines 71 and tear-away means 72 consisting, in a manner known per se, of a central gripping hole connected to the four corners of the board by breakable and/or pre-cut-out lines 73 for tearing away the board.

Figure 13:
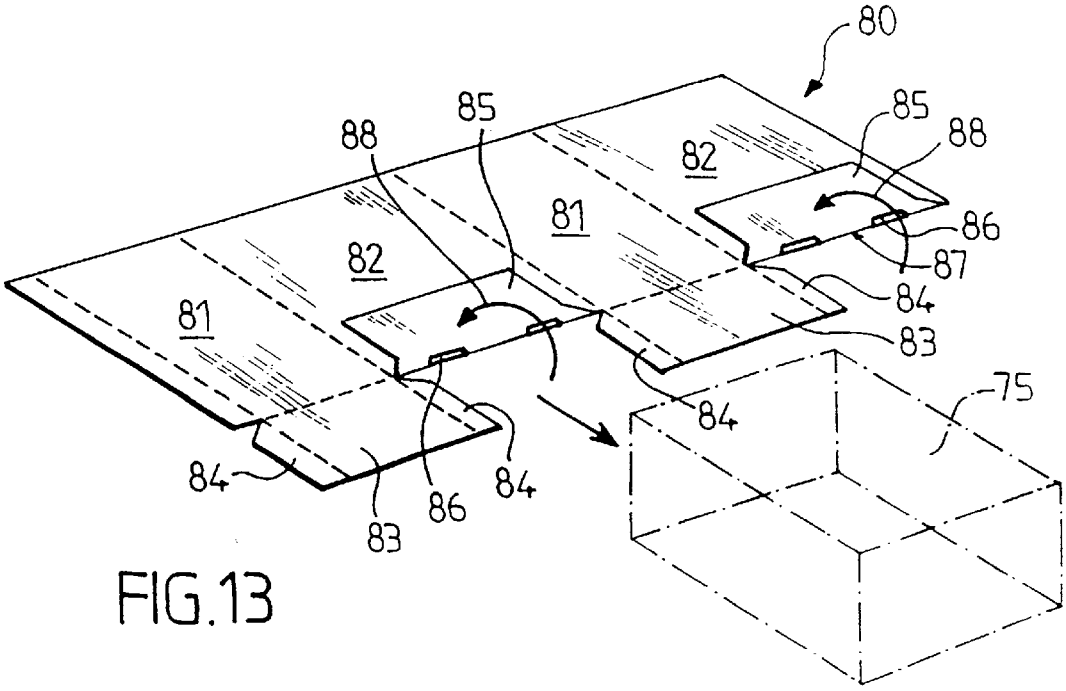
FIGS. 13 and 14 show another embodiment of a case according to the invention, with four sections, with forming about a mandrel.
Figure 14:
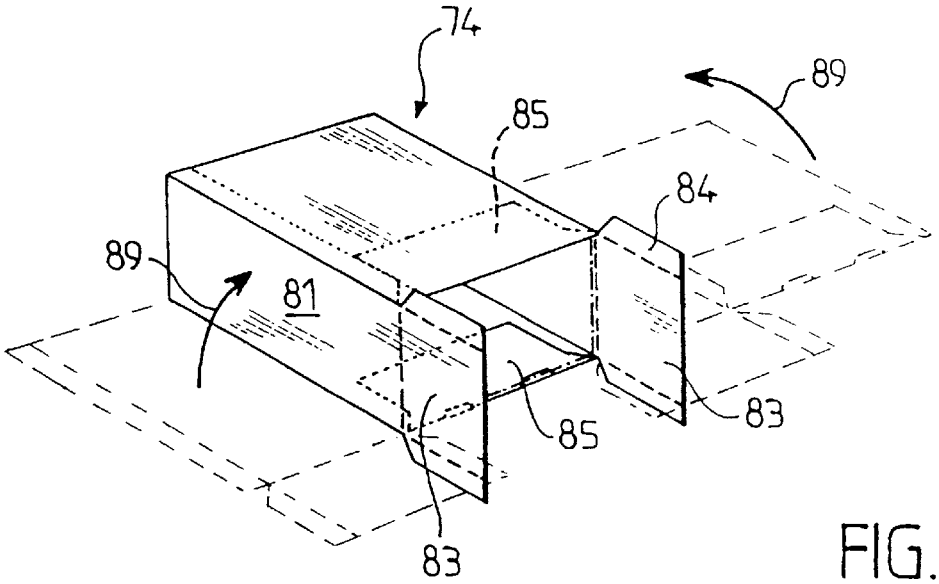

FIGS. 13 and 14 show an embodiment of a case 74 with four sides produced by rolling about a mandrel 75 from a blank 80 equipped with four principal sections and with a set of four corresponding flaps, the second flaps being used as a double turn-down.

More specifically, FIG. 13 shows a blank 80 equipped with two first principal sections 81 and with two second principal sections 82, the first principal sections being equipped with first flaps 83 provided with two lateral tongues 84 and the second principal sections 82 each including a second flap 85 equipped with recesses 86 on the second joining line 87, arranged in order to cooperate with the facing tenons of the board in question, the said second flaps 85 being folded down (arrow 88) and bonded to the inner face of the second sections 82.

The assembly thus formed, as shown in FIG. 13, the first flaps being flat in the extension of the first sections and the second flaps having been previously folded down and bonded to the inner face of the second sections, the blank is rolled up (arrow 89, FIG. 14) about the mandrel in order to form the half-case, using, for example, the process and the apparatus described in Patent FR-90/09457.

Figure 15:
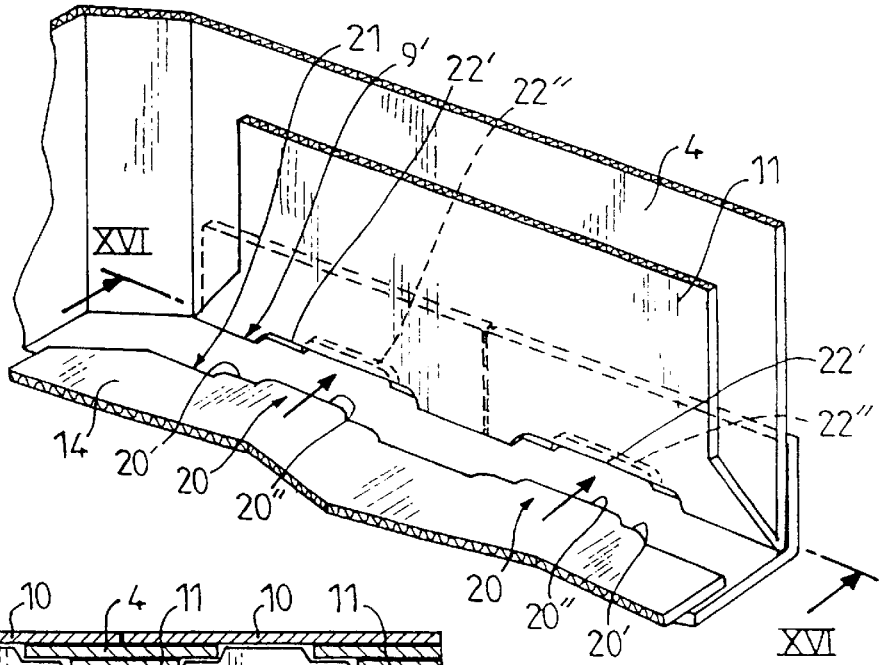
FIG. 15 shows an exploded perspective view of the join between board and second section, of an assembly intended to form a half-case according to the embodiment of the invention of FIG. 1.

FIG. 15 shows, in exploded view and in section, the detail of the snap-fitting of the board 14 according to the embodiment of the invention of FIGS. 1 to 8.

The board 14 includes, here, on each of its longitudinal edges 21, two tenons 20, called two-stage tenons, namely a first stage 20' and an end stage 20".

On the case-wall side, provision is made for a first recess 22' made above the second joining line 9' in the second turned-down flap 11, with a shape which complements the first tenon part forming the first stage, and a second recess 22" of complementary shape which cooperates with the second stage 20", the second recess, being in the facing second section 4, permitting penetration of the tenon over two thicknesses of cardboard wall.

Figure 16:
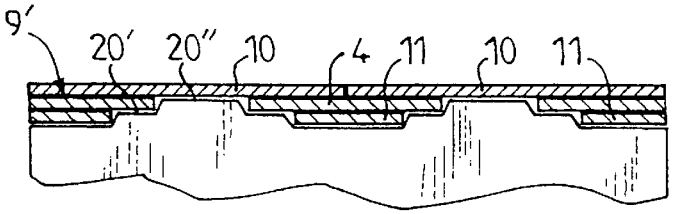
FIG. 16 is a sectional view along VIII—VIII of FIG. 15.

In FIG. 16 it is thus possible to see that the two-stage component makes it possible to penetrate deeply into the wall of the case, the turn-down tabs 10 of the first flaps, bonded to the outer face of the second section 4, making it possible to protect the recesses thus made and the film wedged between board and wall (not shown).

Figure 17:
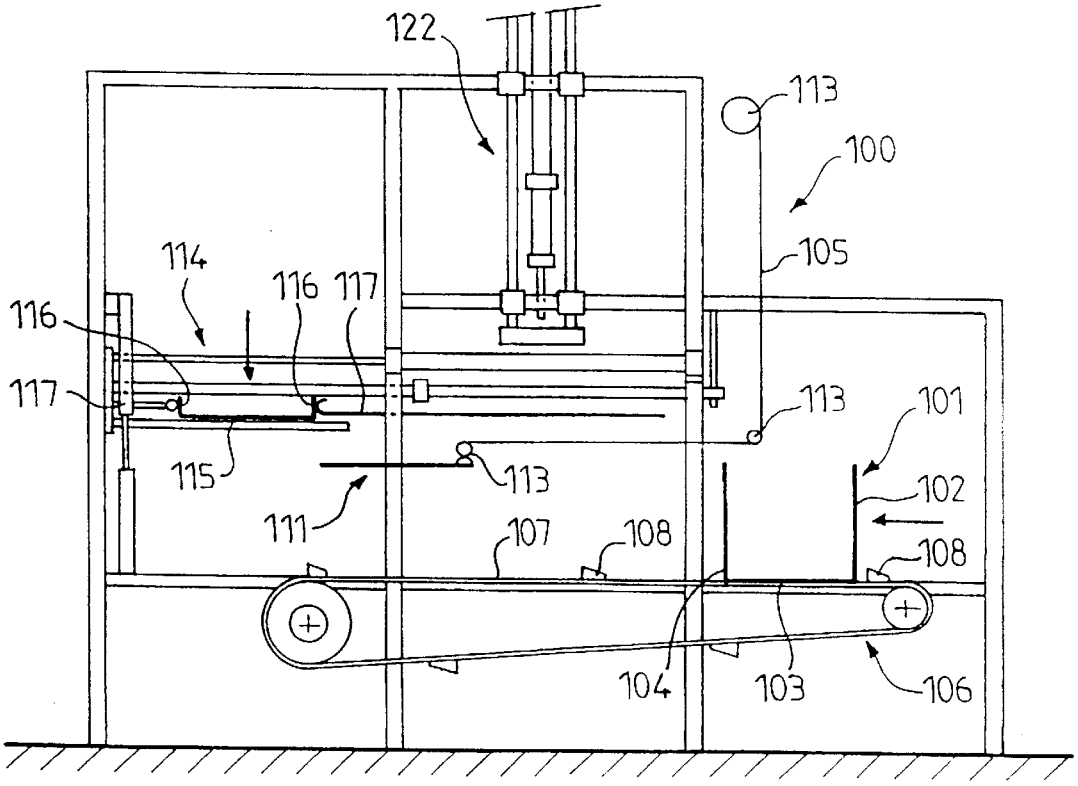
Figure 18:
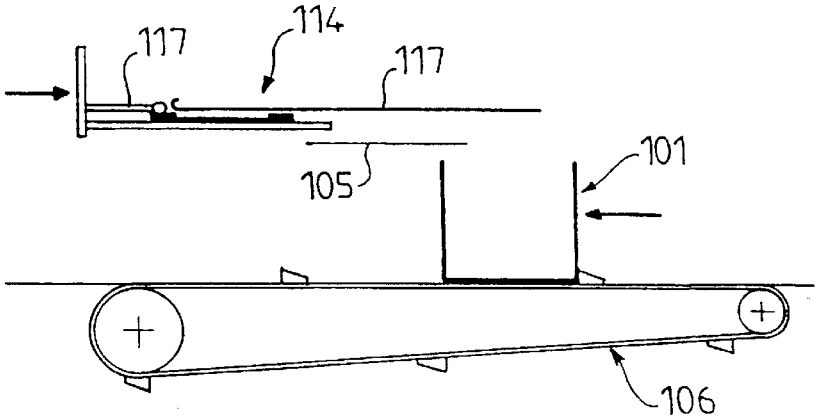
Figure 20:
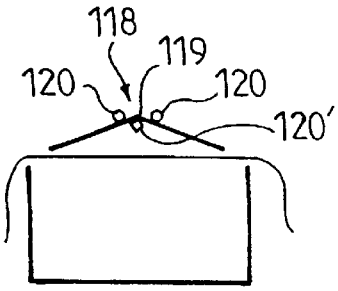
Figure 19:
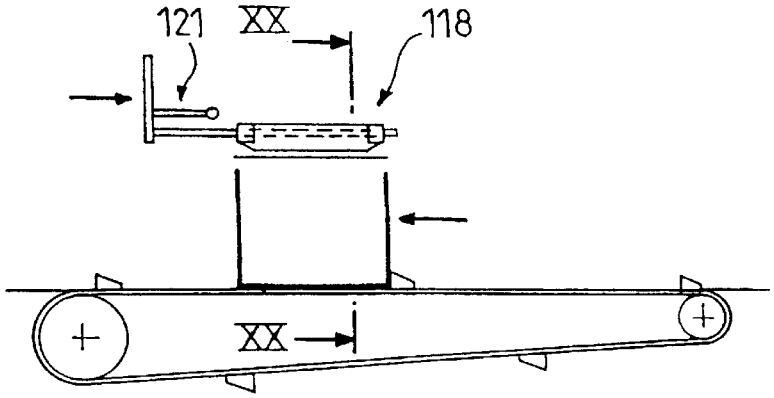
Figure 21:
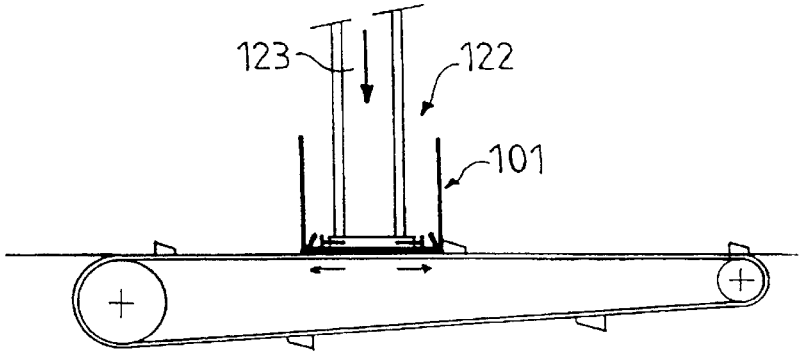
Figure 22:
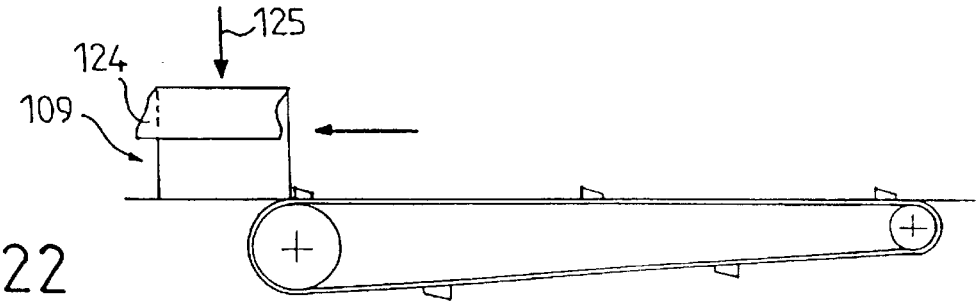
Figure 23:
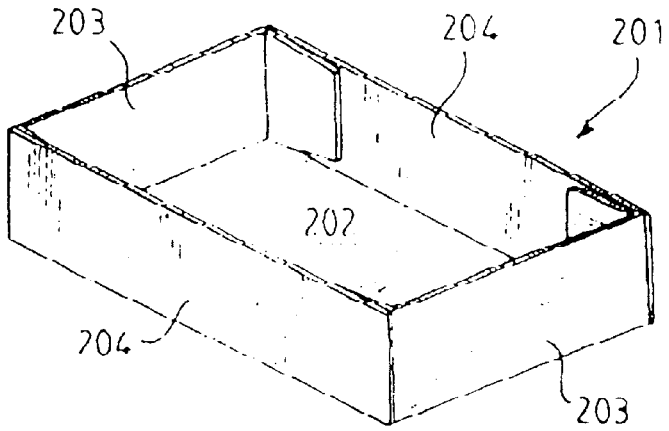

FIG. 17 shows a device loo for manufacturing a cardboard packing case or the like for the transportation of a load, the said case being formed from a half-case 101 comprising a lateral surround 102 formed from at least four vertical walls and from a horizontal base 103 secured to the said surround by joining lines 104 and a film 105 made from heat-shrinkable plastic material intended for packaging and for holding the load in position.

The device comprises means (not shown) for forming the base and the vertical walls of the case, for example including a mandrel, as shown in FIGS. 13 and 14, means 106 for bringing the half-case into the position for fitting of the board, for example comprising a noria-conveyor-type conveyor belt 107, with stop 108 for holding the case, and means 109 (cf. FIG. 22) for taking the half-case equipped with its film made from plastic material towards the station for filling with the load (not shown).

The device 100 comprises means 111 for presenting the film 105 made from plastic material above the case, for example by means of rollers 113 drawing the film continuously over the case, and means for cutting the film to the dimensions and for cutting the perforated part (not shown) which are known per se.

Means 114 for preparing the board 115 according to the invention with the third flaps 116 being placed upright are provided.

They comprise rams 117 for righting the third flaps 116 and then folding them towards the centre of the board, and means for coating (not shown) the top of the said third flaps with adhesive.

The device (cf. FIGS. 19 and 20) comprises means 118 for folding the board into a Chinese-hat shape about a longitudinal folding line 119, for example over the film.

The folding means 118 comprise, for example, (cf. FIG. 20) two rollers 120 and a counterroller 120', which are retractable.

Rams 121 mounted on a two-and-fro carriage allow the board to be positioned over the film made from plastic material.

The device 100 comprises means 122 for inserting the board, held in the shape of a Chinese hat, for example pushing the film into the case.

In an advantageous embodiment, the device includes means (not shown) for inserting the plastic film separately from the board, allowing the film to be positioned in the box prior to the insertion of the Chinese-hat-shape board.

The means for insertion, in particular, of the board comprise, for example, a piston 123, the said means then being suitable for pressing the board down on the base of the half-case 101, pushing on top until it grips, with pressure, the central part of the heat-shrinkable film on the inner face of the base, allowing the free curtain portions 124 made from plastic material to escape on either side, extending from the opposite edges of the board over a length which is sufficient to emerge, if appropriate, from the case in a first stage and to cover over the load, in a second stage, fully enveloping it.

Means (not shown) are also provided at the appropriate location for coating, using adhesive, for example, of the hot-melt type, either the lower surface of the board or the base of the case, over a suitable area.

It should be recalled, in fact, that the device advantageously includes means (not shown) for cutting out at least one hole in the film made from plastic material, for fastening the lower face of the board to the facing base of the half-case, through this hole.

The device also includes means 125 for inserting the load into the case, which are known per se, means (not shown) for folding down the curtain portions over the load and means for heating the film, for example by displacement in a heating tunnel, for heat-shrinking over the load.

The packaging is then closed by a lid of the type described above in a manner known per se.

Advantageously in the case more particularly described here, in which the board includes third flaps, these may be either shaped and pressed down on the inner face of the corresponding sections by simple, natural righting of the said third flaps during vertical compression and then flattening of the board, and/or may be pressed down by means of horizontal thrust rams, of the piston type (not shown) inserted into the half-case before withdrawal of the vertical ram.

A description will now be given of a first embodiment of the process for positioning the board according to the invention, with reference to FIGS. 1 to 8 and to FIGS. 17 to 22.

The half-case 1 or 101 is firstly formed, for example about a mandrel.

The film is cut out, perforated and then positioned above the half-case whose base has been previously coated with adhesive.

The board, previously shaped into a Chinese hat, is provided above the plastic film (cf. FIGS. 2 and 20), the board being, for example, held by means of suction cups (not shown) and it is positioned above the sheet made from plastic material.

The board is then inserted (FIG. 3), as a Chinese hat, into the case, for example pushing in the sheet made from plastic material as far as a position in which the sheet is immobilized between board and base by the board being rendered horizontal and abutting and in which the tenons snap-fit into the recesses provided for this purpose, the curtain-portion ends then falling down and, for example, outside the case over the walls.

They may also fall down inside, but this then requires them to be moved apart, in order to insert the load, with parting means, for example by means of suction or manually.

The third flaps are then bonded to the inner faces of the first sections and then the load is positioned.

The curtain portions are then closed over the load and the assembly is then heat-shrunk and the packaging is completed by the lid being fitted, as indicated above.

FIGS. 23 to 28 show a case 201 for packing a load which is obtained from a tray comprising a base 202 and four side walls, namely two first opposite walls 203 and two second opposite walls 204, a film 205 of heat-shrinkable plastic material, as a rectangular layer, equipped with a hole 206, for example in the shape of a rectangular and/or oval slot two to three centimetres wide and 5 to 10 cm long.

The case includes an added, rectangular board 207 of the same size as the cross section of the case comprising a median line 208 for provisional longitudinal folding of the board into a Chinese hat parallel to the second walls 204 of the tray.

The Chinese hat is folded at a sufficiently acute angle, for example less than 60°, for example 40° or less, in order to allow, on either side of its edges 209, an empty space which is wide enough to avoid any damage to the plastic film 205 and to allow the descent arm and application movement of the film on either side of the inverted-V board.

The process for manufacturing the case corresponding to FIGS. 23 to 28 will now be described in greater detail below.

Figure 24:
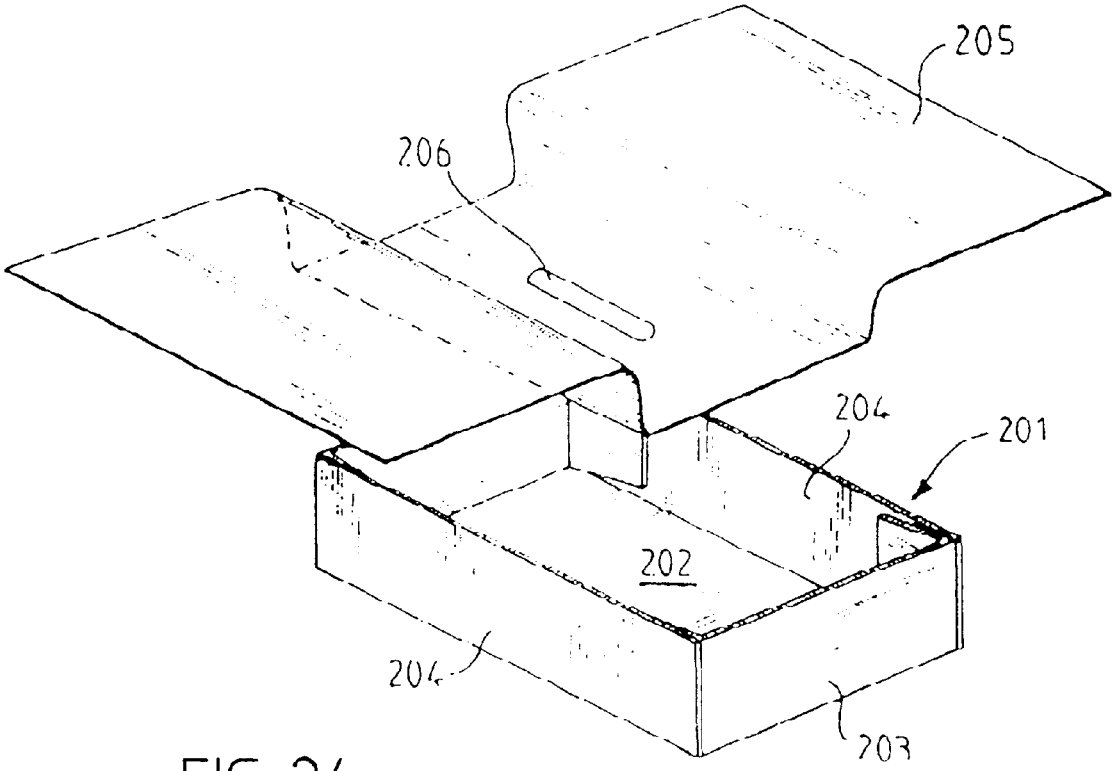
Figure 25:
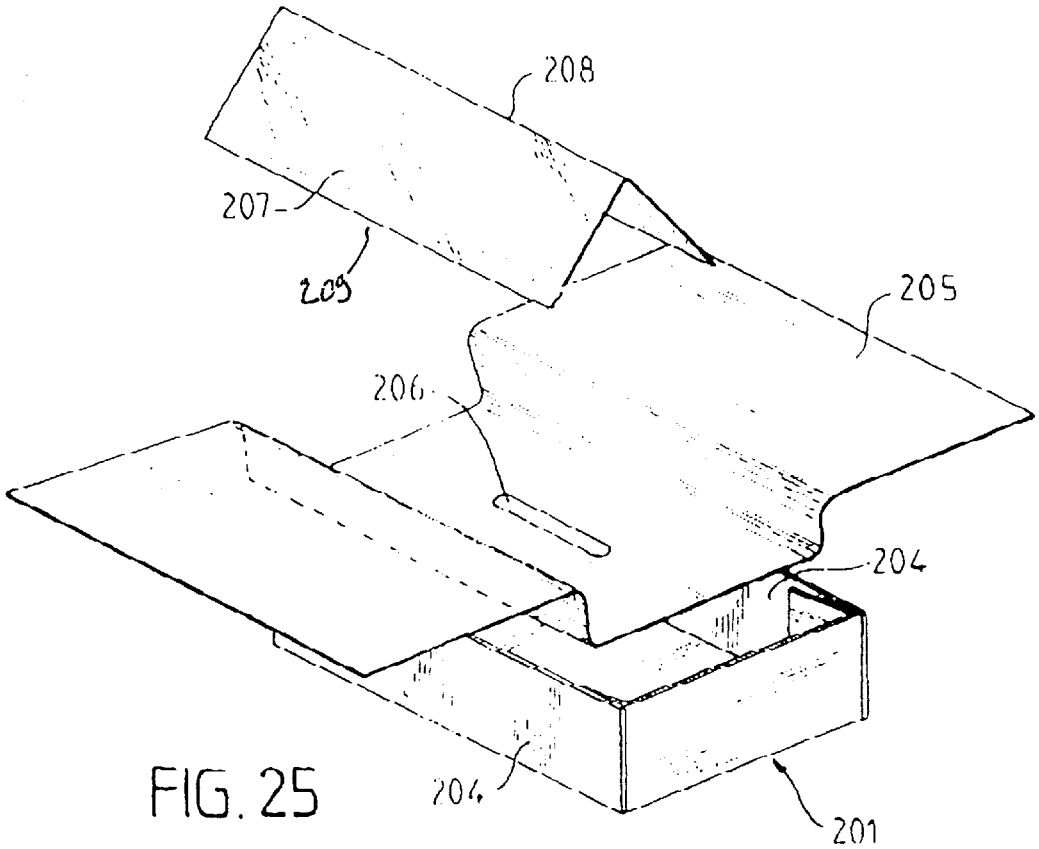
Figure 26:
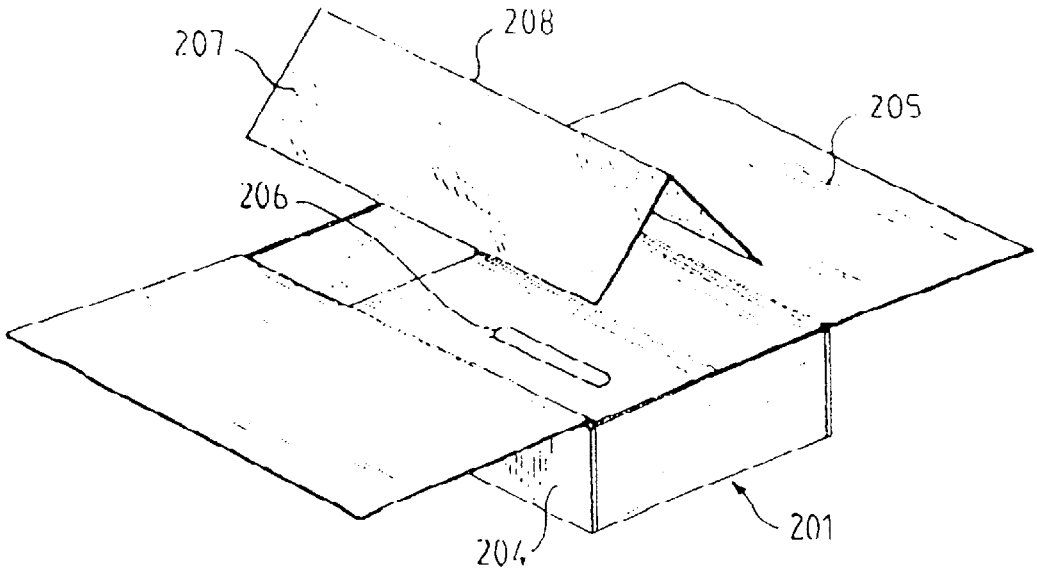
Figure 27:
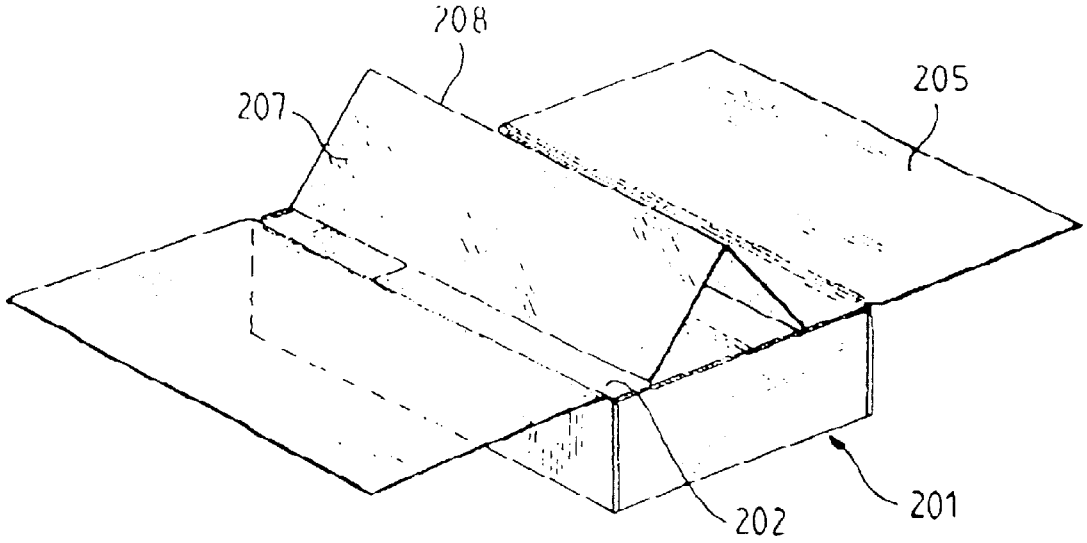
Figure 28:
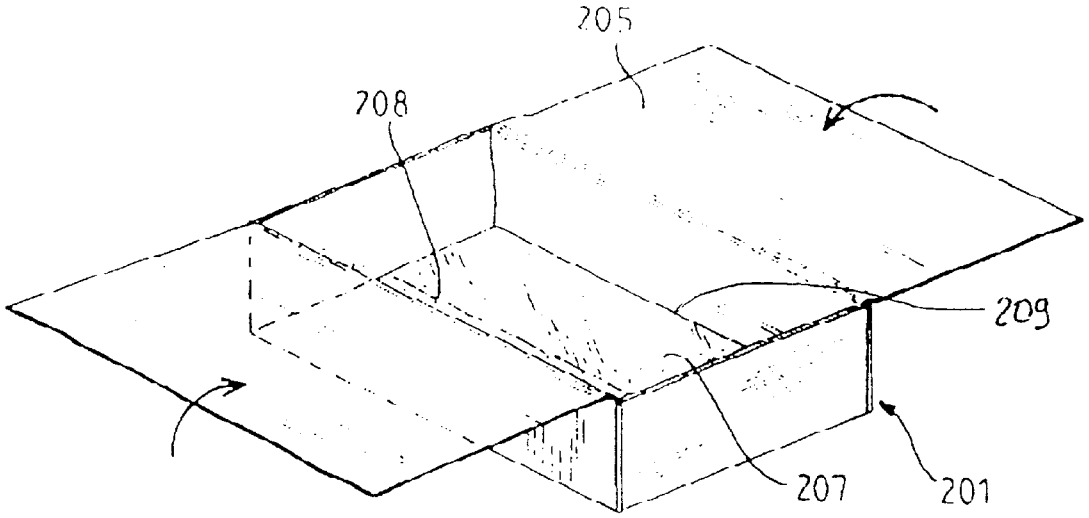

The tray 201 being formed, and the base 202 previously coated with adhesive in line with the slot 206, the plastic film is provided and shaped into a U or into a V below the open face of the tray (cf. FIG. 24).

The plastic film, shaped in this way, is lowered as far as the base 202 of the tray.

The board 207, shaped as a Chinese hat, is then lowered in its turn until its edges 209 abut against the plastic film against which they slide until the board 207 is horizontal and is bonded to the base 202 through the hole 206.

The plastic film is then immobilized on the base by being sandwiched between the base and the board.

Obviously, and as may also be seen from the aforesaid, the present invention is not limited to the embodiments more particularly described.

On the contrary, it encompasses all variants and particularly those in which the board has no third flap, that in which the second sections have no second flaps, or those in which the median line is replaced by two or three parallel median folding lines which are close enough together to allow the board to be shaped substantially as a Chinese hat.

What is claimed is:

1. Cardboard packing case for transporting a load, comprising a base and at least four side walls, said at least four side walls comprising two first opposite walls and two second opposite walls, a film made from heat-shrinkable plastic material, and a horizontal added board for pressing down and holding the heat-shrinkable film flat on an inner face of the base of the case, said board comprising a substantially median line for provisional longitudinal folding of the board into a tent shape, said median line being substantially parallel to the two second walls, wherein said median line comprises a ridge facing towards a top of the case, and wherein the film is in the form of a rectangular curtain in a single piece emerging on either side of two opposite facing edges of said board parallel to the median folding line and extending from said edges over a length which is sufficient to cover over one another, whereby the film is suitable for enveloping said load and immobilizing it by means of heat-shrinking of the film.

2. Case according to claim 1, wherein the board is inserted between the two second opposite side walls of the case so that the edges of the board are in contact, via the film of plastic material, with at least a part of inner lower edges of the case at a bottom of said second walls.

3. Case according to claim 2, wherein the board is inserted forcibly between said inner lower edges of the case in contact with the film at the bottom of said second walls.

4. Packing case according to claim 1, wherein the board comprises, on at least one of said two opposite edges, said two opposite edges being located adjacent the second opposite walls, at least one tenon, said at least one tenon collaborating with at least one corresponding recess in the inner lower edges of the case, at the bottom of said second walls, once the board is in place against the base of the case.

5. Packing case according to claim 1, wherein the board is comprised of corrugated cardboard comprising ribs wherein the ribs are generally perpendicular to lines of contact between said two opposite edges and the second walls.

6. Packing case according to claim 1, wherein a lower face of the board is at least partially directly bonded to the inner face of the base of the case through at least one hole in the film.

7. Case according to claim 1, wherein the board totally covers over the base of the case so as to constitute a double base.

8. Case according to claim 1, wherein the board comprises means for tearing said board from the base, allowing manual separation of the cardboard parts and releasing the plastic material.

9. Case according to claim 1, further comprising a succession of sections forming the side walls of the case, said sections being joined by first joining lines which are parallel to each other, said succession of sections comprising first and second opposite pairs of principal sections and a first set of lateral flaps arranged on a side of the principal sections and joined to the principal sections by second joining lines which are perpendicular to the first joining lines, said lateral flaps comprising at least two first opposite flaps forming, at least partially, the base of the case, the at least two first opposite flaps each comprising, respectively, on two lateral sides, reinforcement tabs, said reinforcement tabs being folded and bonded to an outer face of the second principal sections, said reinforcement tabs corresponding to second walls adjacent to the first principal sections corresponding to the said first flaps, and corresponding to said first walls.

10. Case according to claim 9, further comprising second opposite flaps joined to the second principal sections by the second joining lines.

11. Case according to claim 10, wherein the second flaps are folded through 180 about the second joining lines and are bonded to an inner face of a corresponding second principal section.

12. Case according to claim 4, wherein the at least one tenon comprises a periphery which has two successive stages, and wherein the at least one recess consists of a groove of a shape which complements the at least one tenon passing successively through corresponding second flaps and second principal sections in a direction of a thickness of said second flaps and said second principal sections.

13. Packing case according to claim 9, wherein the first flaps are contiguous at ends opposite the second joining lines with the first sections.

14. Case according to claim 9, wherein the board comprises two opposite third flaps connected to the board by third joining lines, said third joining lines coinciding with the second joining lines between said first principal sections and first flaps, said third flaps being pressed down and bonded to an inner surface of facing first sections.

15. Packing case according to claim 9, wherein the succession of sections comprises a fastening tongue at a first end and an end section at a second end, and wherein said second joining lines are aligned or substantially aligned and the case is arranged so that it can be assembled automatically by folding said sections and flaps of around a mandrel, the end section being fastened to the tongue and the reinforcement tabs of the first opposite flaps being fastened to the outer face of the second walls adjacent the first principal sections to form said case.

16. Case according to claim 15, wherein the succession of sections comprises four principal sections and four intermediate sections separating said four principal sections.

17. Set of blanks for producing a packaging case comprising a first blank adapted to produce a succession of sections suitable for forming side walls of the case, said sections being joined in pairs by first joining lines which are parallel to each another, said succession of sections comprising a bonding tongue at a first end and an end section at a second end and comprising first and second opposite pairs of principal sections, and a first set of lateral flaps arranged on a side and joined to the principal sections by second joining lines which are perpendicular to the first joining lines, said first set of lateral flaps comprising two first flaps and two second flaps adapted to form a base of the case, the two first flaps each comprising, their two lateral sides, reinforcement tabs arranged to be folded down and bonded to an outer face of the second principal sections adjacent to principal sections corresponding to said first flaps once the case has been formed, wherein second joining lines forming a join with the second principal sections each comprise at least one recess;

and a second blank adapted to produce a substantially rectangular board equipped on longitudinal edges with at least one tenon suitable for cooperating with said at least one recess, the board further comprising, on transverse edges, at least one tongue suitable for cooperating with an inner face of a first principal section once the case has been formed, comprising a substantially median line for longitudinal folding of the board into a tent shape, said median line being substantially parallel to longitudinal edges of said board.

18. Set according to claim 17, wherein the board comprises means for tearing said board from the base by pulling.

19. Process for forming a cardboard packing case or the like for the transportation of a load, the process comprising the steps of:

forming a base and vertical walls of a case and leaving the top open, providing a sheet of heat-shrinkable plastic material, providing a board with longitudinal dimensions which are substantially equal to those of the base wherein said board comprises a substantially median folding line parallel to longitudinal sides of said board, and wherein the longitudinal sides are suitable for cooperating with two opposite vertical walls of the case, called second walls, folding the board into a tent shape about said folding line, and placing said board over said sheet of plastic material, positioning the sheet of plastic material and the board in the case such that the board is horizontal and abuts against the base of the case whereby said sheet is immobilized between said board and said base, wherein curtain portions of free plastic material extend from said two longitudinal sides of said board over a sufficient length to fall outside the case over the walls when the sheet of plastic material is pressed down on the base of the case and such that said curtain portions cover over each other, totally enveloping the load, inserting the load into the case and closing said curtain portions over the load, and heat-shrinking the film whereby the load is immobilized, and closing the lid of the case.

20. Process according to claim 19, wherein the sheet of plastic material comprises at least one perforated part, and further comprising the steps of coating at least one of the bottom of the board and the inner face of the base with adhesive, and bonding the board to the base through said perforated part when the board is placed horizontally and abuts against the base.

21. Process according to claim 19, wherein the board comprises two lateral flaps, called third flaps suitable for being pressed down on to opposite facing walls of the case perpendicular to the folding line of the board, further comprising the steps of folding said third flaps against an upper face of the board before inserting the board into the case, coating faces of said third flaps with adhesive, bonding said faces of said third flaps to the walls after pressing the board on the base.

22. Process for forming a case according to claim 19, further comprising the step of forming the base and the walls of the case about a mandrel.

23. Process according to claim 19, wherein the base of the case comprises two first flaps and two second flaps, and further comprising the steps of folding the second flaps down through 180 about joining lines with the walls and bonding the second flaps to inner faces of the adjacent walls.

24. Device according to claim 23, further comprising means for forming the base and the walls of the case about a mandrel.

25. Device for manufacturing a cardboard packing case for transportation of a load, said case comprising a lateral surround formed from at least four vertical walls and a horizontal base secured to said surround via joining lines, and a heat-shrinkable plastic film material, the device comprising means for forming the base and the vertical walls of the case, means for providing the plastic film over said case, means for providing a board above the case, wherein the board is adapted to be folded into a tent shape about a longitudinal folding line of said board when said board is above said film, and means for inserting the film into the case and inserting the board in the shape of a tent into said case, said means for inserting being suitable for pressing down said board until the heat-shrinkable film is pressed down on an inner face of the base of the case, allowing curtain portions of free material to escape on either side of two opposite facing edges of said board and to cover over one another, totally enveloping the load.

26. Device according to claim 25, further comprising means for cutting out at least one hole in the film and means for coating at least one of a lower face of the board and a portion of the base of the case facing said hole with adhesive after insertion of said film into the case.

27. Device according to claim 25, further comprising means for inserting the load into the case, means for folding down the curtain portions over the load, and means for heating the film in order to heat shrink it over the load.

28. Device according to claim 25, wherein the board comprises third lateral flaps, and wherein the device comprises means for folding said third lateral flaps against an upper face of the board and means for coating said third lateral flaps with adhesive.

* * * * *